US012612825B2

(12) United States Patent
Ignova et al.

(10) Patent No.: US 12,612,825 B2
(45) Date of Patent: Apr. 28, 2026

(54) DIRECTIONAL DRILLING ADVISING FOR ROTARY STEERABLE SYSTEM

(71) Applicant: Schlumberger Technology Corporation, Sugar Land, TX (US)

(72) Inventors: Maja Ignova, Stonehouse (GB); Samba Ba, Beijing (CN); Katharine Mantle, Stonehouse (GB); Ekaterina Brovko, Stonehouse (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 179 days.

(21) Appl. No.: 18/247,658

(22) PCT Filed: Oct. 1, 2021

(86) PCT No.: PCT/US2021/071672
§ 371 (c)(1),
(2) Date: Apr. 3, 2023

(87) PCT Pub. No.: WO2022/073027
PCT Pub. Date: Apr. 7, 2022

(65) Prior Publication Data

US 2023/0392447 A1 Dec. 7, 2023

Related U.S. Application Data

(60) Provisional application No. 63/198,175, filed on Oct. 1, 2020.

(51) Int. Cl.
*E21B 7/04* (2006.01)
*E21B 44/00* (2006.01)
(Continued)

(52) U.S. Cl.
CPC ..... *E21B 7/04* (2013.01); *E21B 44/00* (2013.01); *E21B 45/00* (2013.01); *E21B 47/024* (2013.01); *E21B 47/13* (2020.05); *E21B 2200/20* (2020.05)

(58) Field of Classification Search
CPC . E21B 44/00; E21B 7/04; E21B 7/068; E21B 7/06; E21B 7/067
See application file for complete search history.

(56) References Cited

U.S. PATENT DOCUMENTS

2011/0213601 A1* 9/2011 Pirovolou ..... E21B 7/04 703/10
2015/0275646 A1 10/2015 Benson
(Continued)

FOREIGN PATENT DOCUMENTS

WO 2019178460 A1 9/2019
WO 2020191360 A1 9/2020

OTHER PUBLICATIONS

Search Report and Written Opinion of International Patent Application No. PCT/US2021/071672 dated Jan. 10, 2022, 10 pages.

*Primary Examiner* — Tara Schimpf
*Assistant Examiner* — Ursula Lee Norris
(74) *Attorney, Agent, or Firm* — Kyle R. Miiller

(57) ABSTRACT

A method for controlling a drilling trajectory of a downhole tool includes receiving a drilling plan for a downhole tool to drill a wellbore toward a target in a subterranean formation. The method also includes receiving a measured drilling trajectory of the downhole tool after the downhole tool drills a first portion of the wellbore using the planned drilling trajectory. The method also includes determining a state of the downhole tool based at least partially upon the planned drilling trajectory and the measured drilling trajectory. The state includes a difference between the planned drilling trajectory and the measured drilling trajectory, a level of
(Continued)

control of a steering capability of the downhole tool, and a location of an end of the wellbore. The method also includes generating a working plan trajectory based at least partially upon the state of the downhole tool and the drilling plan.

20 Claims, 5 Drawing Sheets

(51) Int. Cl.

| | |
|---|---|
| ***E21B 45/00*** | (2006.01) |
| ***E21B 47/024*** | (2006.01) |
| *E21B 47/13* | (2012.01) |

(56) References Cited

U.S. PATENT DOCUMENTS

| | | | | |
|---|---|---|---|---|
| 2016/0265334 | A1 | 9/2016 | Dykstra | |
| 2016/0290118 | A1* | 10/2016 | Xue | G05B 15/02 |
| 2017/0211372 | A1 | 7/2017 | Samuel | |
| 2018/0003026 | A1 | 1/2018 | Boone | |
| 2018/0106133 | A1* | 4/2018 | Bolchover | E21B 41/00 |
| 2018/0340408 | A1 | 11/2018 | Samuel | |
| 2020/0095860 | A1 | 3/2020 | Zalluhoglu | |

* cited by examiner

DIRECTIONAL DRILLING ADVISING FOR ROTARY STEERABLE SYSTEM

CROSS-REFERENCE TO RELATED APPLICATIONS

This application is a National Stage Entry of International Application No. PCT/US2021/071672, which was filed on Oct. 1, 2021, which claims priority to U.S. Provisional Patent Application No. 63/198,175, filed on Oct. 1, 2020, the entirety of which is incorporated by reference herein.

BACKGROUND

Directional drilling refers to the intentional deviation of a wellbore from the path it would naturally take. This is accomplished through the use of whipstocks, bottomhole assembly (BHA) configurations, instruments to measure the path of the wellbore in three-dimensional space, data links to communicate measurements taken downhole to the surface, mud motors, rotary steerable systems, and drill bits. The directional driller also exploits drilling parameters such as weight on bit and rotary speed to deflect the bit away from the axis of the existing wellbore.

In some cases, such as drilling steeply dipping formations or unpredictable deviation in conventional drilling operations, directional-drilling techniques may be employed to ensure that the hole is drilled vertically. While many techniques can accomplish this, the general concept is simple: point the bit in the direction that one wants to drill. The most common way is through the use of a bend near the bit in a downhole steerable mud motor. The bend points the bit in a direction different from the axis of the wellbore when the entire drillstring is not rotating. By pumping mud through the mud motor, the bit turns while the drillstring does not rotate, allowing the bit to drill in the direction it points.

When a particular wellbore direction is achieved, that direction may be maintained by rotating the entire drillstring (including the bent section) so that the bit does not drill in a single direction off the wellbore axis, but instead sweeps around and its net direction coincides with the existing wellbore. Rotary steerable tools allow steering while rotating, usually with higher rates of penetration and ultimately smoother boreholes. Directional drilling is common in shale reservoirs because it allows drillers to place the borehole in contact with the most productive reservoir rock.

SUMMARY

A method for controlling a drilling trajectory of a downhole tool is disclosed. The method includes receiving a drilling plan for a downhole tool to drill a wellbore toward a target in a subterranean formation. The drilling plan includes a planned drilling trajectory for the downhole tool, a model of a steering capacity for the downhole tool, a dogleg severity for the downhole tool, and properties of the subterranean formation. The method also includes receiving a measured drilling trajectory of the downhole tool after the downhole tool drills a first portion of the wellbore using the planned drilling trajectory. The method also includes determining a state of the downhole tool based at least partially upon the planned drilling trajectory, the model, the dogleg severity, the properties of the subterranean formation, and the measured drilling trajectory. The state includes a difference between the planned drilling trajectory and the measured drilling trajectory, a level of control of a steering capability of the downhole tool, and a location of an end of the wellbore. The method also includes generating a working plan trajectory based at least partially upon the state of the downhole tool and the drilling plan. The downhole tool is configured to switch from the planned drilling trajectory to the working plan trajectory to drill a second portion of the wellbore toward the target in the subterranean formation.

A computing system is also disclosed. The computing system includes one or more processors and a memory system. The memory system includes one or more non-transitory computer-readable media storing instructions that, when executed by at least one of the one or more processors, cause the computing system to perform operations. The operations include receiving a drilling plan for a downhole tool to drill a wellbore toward a target in a subterranean formation. The drilling plan includes a planned drilling trajectory for the downhole tool, a predictive steering model for the downhole tool, a dogleg severity for the downhole tool, and properties of the subterranean formation. The operations also include receiving a measured drilling trajectory of the downhole tool after the downhole tool drills a first portion of the wellbore using the planned drilling trajectory. The operations also include determining a state of the downhole tool based at least partially upon the planned drilling trajectory, the predictive steering model, the dogleg severity, the properties of the subterranean formation, and the measured drilling trajectory. The state includes a difference between the planned drilling trajectory and the measured drilling trajectory, a level of control of a steering capability of the downhole tool, and a location of an end of the wellbore. The location of the end of the wellbore is based at least partially upon a location of a sensor on the downhole tool, a distance between the sensor and a drill bit of the downhole tool, a shape of the downhole tool, and a direction that the downhole tool is drilling. The operations also include generating a working plan trajectory based at least partially upon the state of the downhole tool. The downhole tool is configured to switch from the planned drilling trajectory to the working plan trajectory to drill a second portion of the wellbore toward the target in the subterranean formation.

A system for controlling a drilling trajectory of a downhole tool is also disclosed. The system includes a planning platform located at a surface. The planning platform is configured to generate a drilling plan for a downhole tool to drill a wellbore toward a target in a subterranean formation. The drilling plan includes a planned drilling trajectory for the downhole tool, a predictive steering model for the downhole tool, a dogleg severity for the downhole tool, properties of the subterranean formation, and anti-collision data. The system also includes an execution platform also located at the surface and in communication with the planning platform. The execution platform is configured to receive a measured drilling trajectory of the downhole tool after the downhole tool drills a first portion of the wellbore using the planned drilling trajectory. The execution platform is also configured to determine a state of the downhole tool based at least partially upon the planned drilling trajectory, the predictive steering model, the dogleg severity, the properties of the subterranean formation, and the measured drilling trajectory. The state includes a difference between the planned drilling trajectory and the measured drilling trajectory, a level of control of a steering capability of the downhole tool, and a location of an end of the wellbore. The execution platform is also configured to generate a working plan trajectory based at least partially upon the state of the downhole tool and the anti-collision data. Generating the working plan includes generating a plurality of working plan trajectories from a current location of the downhole tool to the target in the subterranean formation, ranking the plurality of working plan trajectories, and selecting one of the plurality of working plan trajectories based upon the ranking. The system also includes a drilling platform located in the downhole tool. The drilling platform is in communication with the execution platform. The drilling platform is configured to receive the working plan trajectory. The downhole tool is configured to switch from the planned drilling trajectory to the working plan trajectory to drill a second portion of the wellbore toward the target in the subterranean formation. The drilling platform is also configured to measure one or more downhole parameters after the downhole tool has switched to the working plan trajectory. The one or more downhole parameters include a downhole drill state of the downhole tool and the rate of penetration of the downhole tool. The drilling plan is also configured to transmit the one or more downhole parameters to the execution platform.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
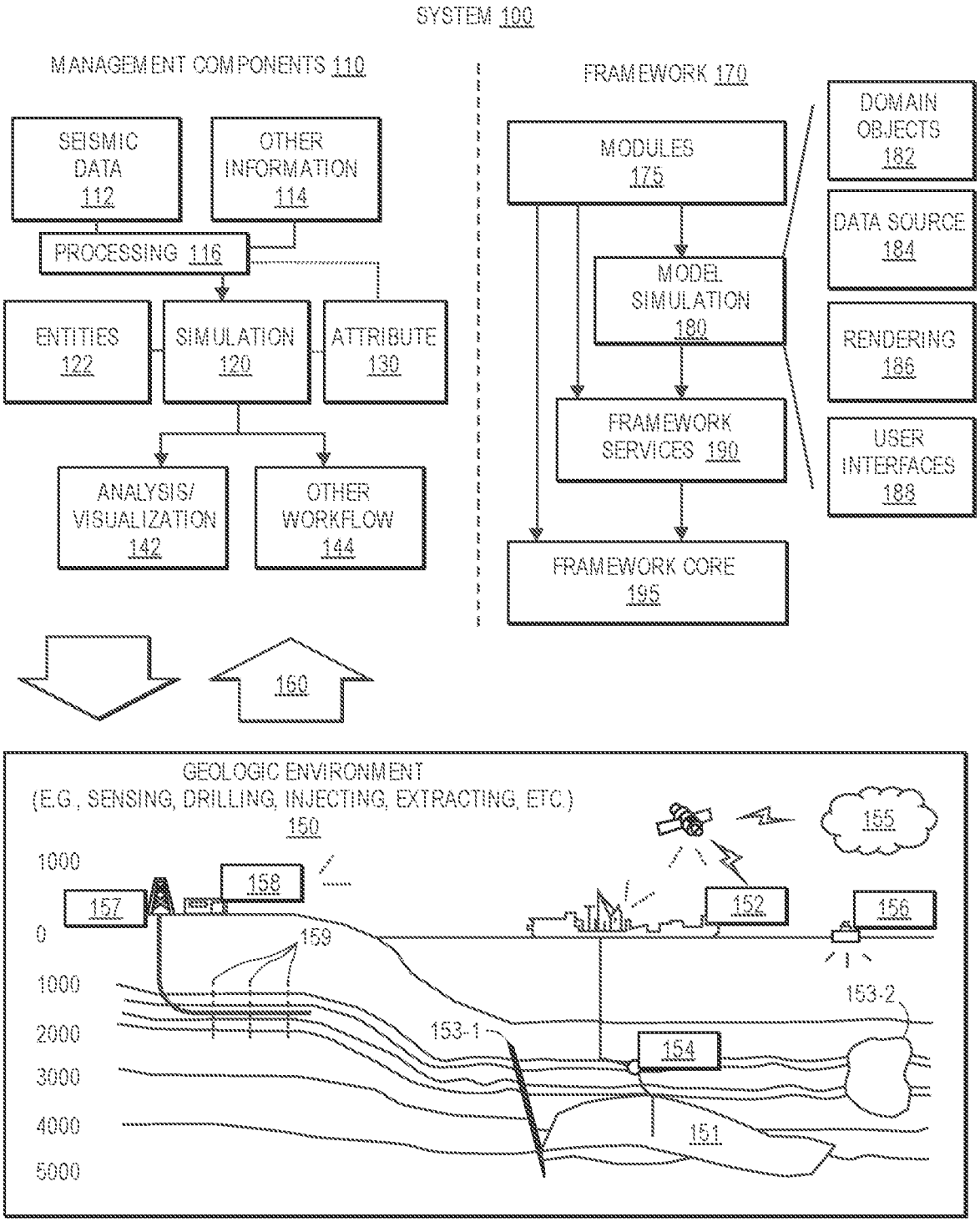
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT® .NET® framework (Redmond, Washington), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Texas), the INTERSECT™ reservoir simulator (Schlumberger Limited, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Embodiments of the present disclosure may provide a method for automatically performing directional drilling operations and/or advising on directional drilling operations when using a rotary steerable system with a firmware capable of performing downhole state estimation. When performing directional-drilling operations onsite or remotely, a series of tasks may be performed. These tasks may begin by planning for the well by providing a detailed planned trajectory to follow and, in some cases, planned operational parameters to drill the well efficiently and without incident. During drilling, the tasks may include taking input (e.g., sensing the state of the current trajectory including the deviation from the original plan, sensing the state of the operations to understand whether the drill bit is on bottom drilling or not, and sensing the operational risks of unplanned events). From this input, inferences may be made, such as drilling parameter values (e.g., rate of penetration (ROP), downhole weight on bit (WOB), and downhole torque). Based on the input and the determined parameters, the tasks may include choosing steering mode, choosing drilling parameters, and automatically resetting or adjusting the downhole drill commands of the rotary steerable system. Further, the response of the drilling system to the parameters may be evaluated (e.g., continually) with respect to the desired outcome. Constraints may be updated based on the outcome, and risk matrices for the occurrence of different events may also be updated. The method may be performed at least partially at the rig site or remotely therefrom. The method may be performed to advise drilling operators or to partially or fully automate the drilling process.

Figure 2:
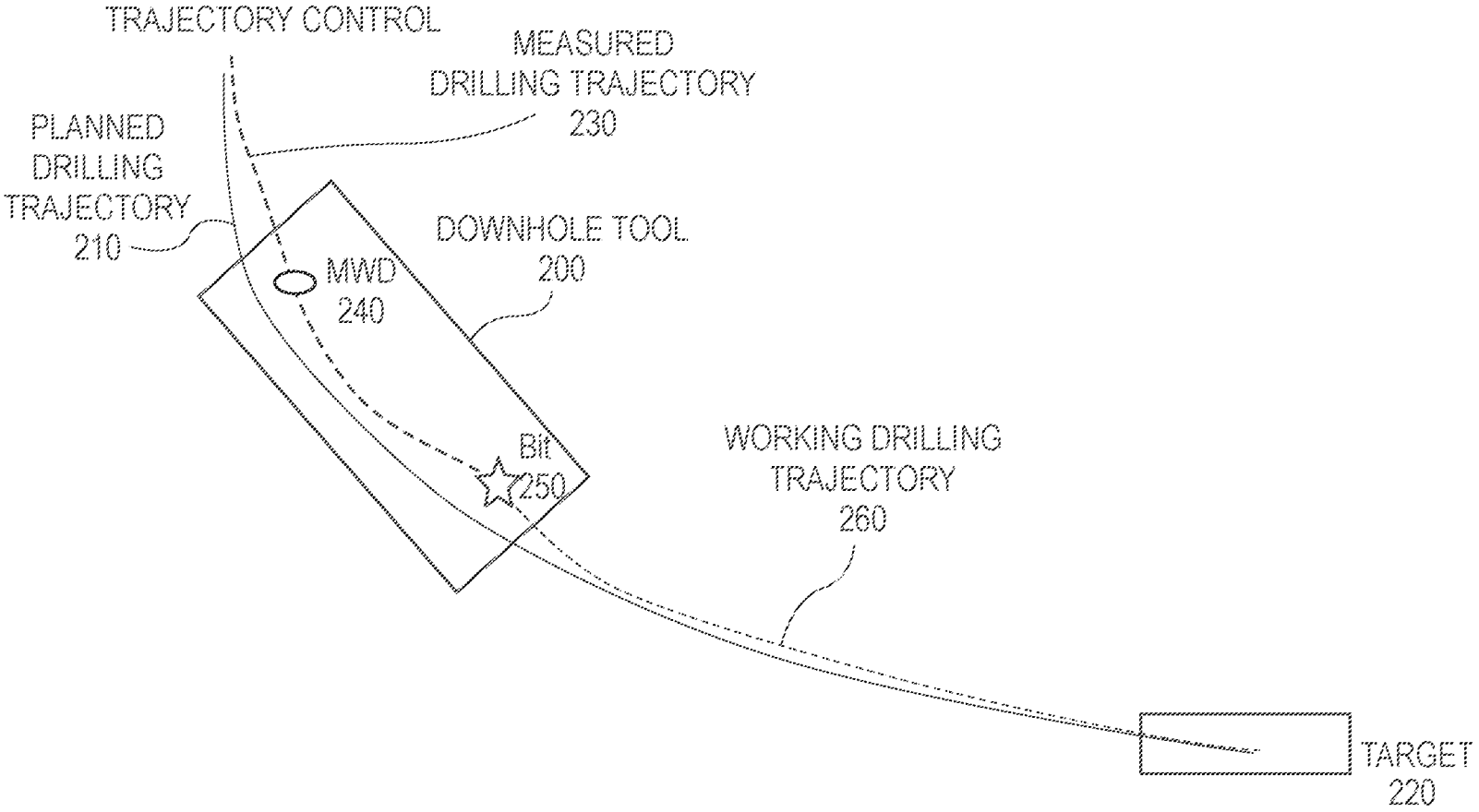
FIG. 2 illustrates a schematic view of a planned drilling trajectory, a measured drilling trajectory, and a working drilling trajectory for a downhole tool, according to an embodiment.

FIG. 2 illustrates a schematic view of a planned drilling trajectory, a measured (e.g., actual) drilling trajectory, and a working drilling trajectory for a downhole tool 200, according to an embodiment. The curve 210 represents the originally planned drilling trajectory, and the box 220 represents the drilling target in the subterranean formation.

In FIG. 2, the downhole tool 200 has already drilled a first portion of the wellbore toward the target 220 along a measured drilling trajectory 230. The measured drilling trajectory 230 may be measured by one or more sensors, which may be part of the downhole tool 200. The sensors may operate within a predetermined tolerance. As may be seen, the downhole tool 200 includes a MWD module 240 and a drill bit 250 that is above the drill bit 250. The MWD module 240 may include the sensors that measure the current location and/or the measured drilling trajectory 230.

As may be seen, the measured drilling trajectory 230 does not overlap with the planned drilling trajectory 210. As a result, a working drilling trajectory 260 may be determined to have the downhole tool 200 drill a second portion of the wellbore from its current location to the target 220. As discussed below, determining the working drilling trajectory 260 may be an iterative process that occurs a plurality of times at a plurality of depths as the wellbore is drilled.

Figure 3:
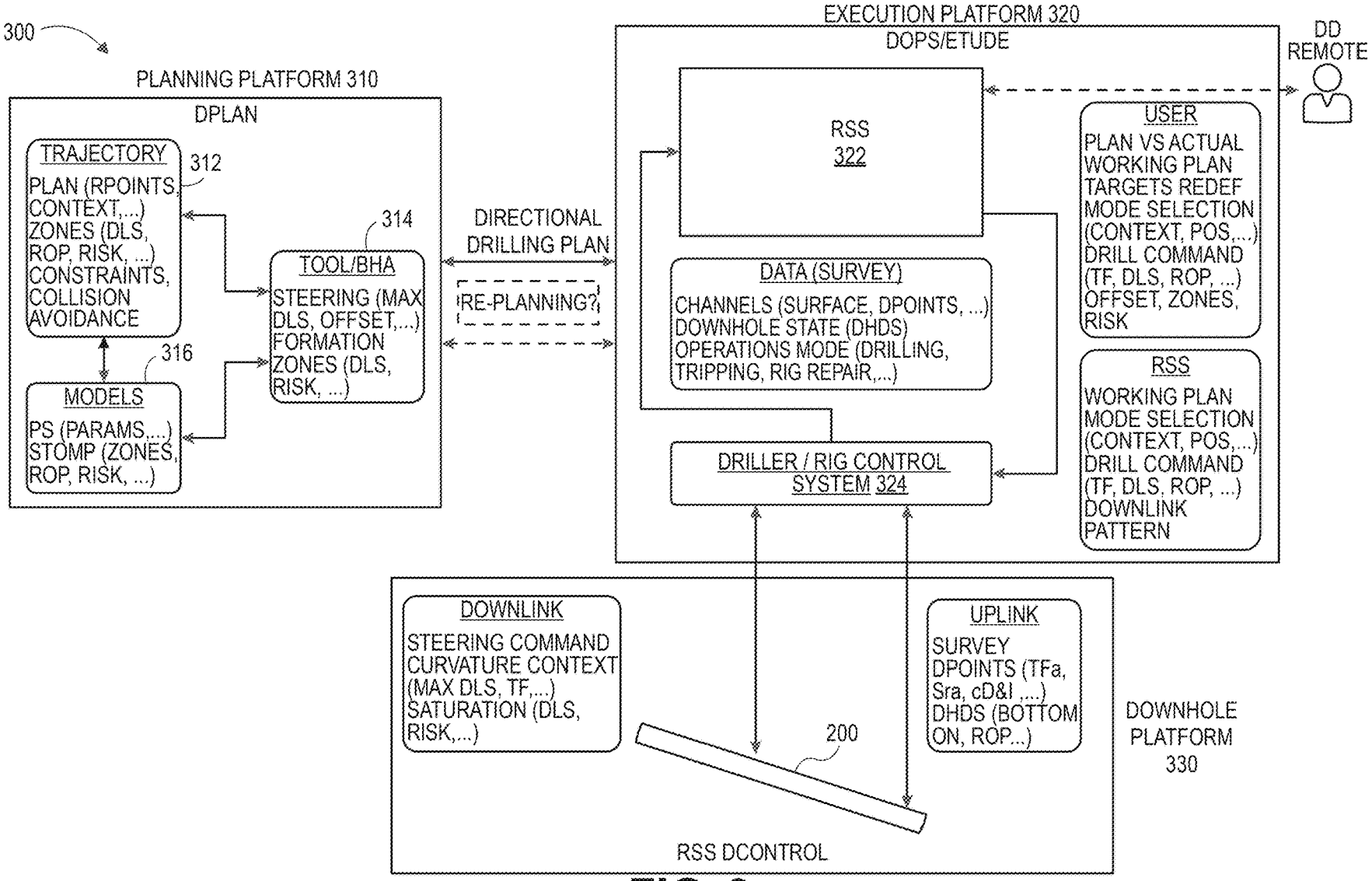
FIG. 3 illustrates a system for monitoring and controlling a drilling trajectory of the downhole tool, according to an embodiment.

FIG. 3 illustrates a system 300 for monitoring and controlling a drilling trajectory of the downhole tool 200, according to an embodiment. The system 300 may reduce or eliminate user interaction by automating at least a portion of the directional drilling process. The system 300 may include an automated directional drilling platform, which may include three parts: a planning platform 310, an execution platform 320, and a downhole platform 330.

Planning Platform 310

The planning platform 310 may be located at the surface (i.e., above the subterranean formation). The planning platform 310 may be configured to generate a drilling plan, which provides the execution platform 320 with information and context to perform a (e.g., directional) drilling operation. The planning platform 310 may also monitor the progress of the drilling operation. This monitoring may be done onsite or remotely. In addition, the planning platform 310 may determine whether revisions to the original drilling plan (e.g., the planned drilling trajectory 210 and/or the target 220) are warranted.

The planning platform 310 may include a trajectory module 312, a tool (or bottom hole assembly (BHA)) module 314, and a modeling module 316, which may together generate the drilling plan. The trajectory module 312 may be configured to generate the planned drilling trajectory 210 (see FIG. 2) with contexts and reference points. The planned drilling trajectory 210 may also include properties (e.g., pressure, temperature, resistivity, porosity, sonic velocity, gamma ray, etc.) of one or more zones in the subterranean formation for anticipating different formation reactions to the downhole tool 200, different ROPs, different risk levels, different drilling performance or steering performance parameters, or a combination thereof. The trajectory module 312 may also include trajectories of nearby wells for collision avoidance purposes (i.e., to avoid collisions with the nearby wells). The planning platform 310 may also implement constraints related to the specific clients or field operations.

The tool/BHA module 314 may gather data related to the steering capacity of the downhole tool 200 including the dogleg severity (DLS) capability and estimations, the neutral steering tendency, the offsets expected for the zones, steerability variations for each zone, or a combination thereof. As used herein, the neutral steering tendency refers to the default steering tendency of the downhole tool 200 (e.g., the BHA) when no particular command direction is provided to the downhole tool 200.

The modeling module 316 may implement model selections, initializations, and re-initializations. Models that may be employed by the modeling module 316 may include predictive steering (PS) models for drilling parameters selection, subsurface transport over multiple phases (STOMP) for real-time zone identifications, offset well prediction models, or a combination thereof. For example, the models may be based upon data collected while drilling one or more nearby offset wells.

Execution Platform 320

The execution platform 320 may also be located at the surface. In one embodiment, the planning platform 310 and the execution platform 320 may be part of the same computing system. In another embodiment, the planning platform 310 may be part of a first computing system, and the execution platform 320 may be part of a second computing system.

The execution platform 320 may receive the drilling plan (e.g., planned drilling trajectory 210, the drilling parameters, and the offset well information) from the planning platform 310, along with nearby well trajectories for anti-collision purposes. In one embodiment, the execution platform 320 may also be configured to communicate with a user. For example, the data communicated between the execution platform 320 and the user may include the planned drilling trajectory 210, the measured drilling trajectory 230, the difference therebetween, the working drilling trajectory 260, the location of the target 220, the mode selection (e.g., context, position, etc.), drill commands (e.g., toolface (TF), DLS, ROP, etc.), offset well data, zones for anticipating different formation reactions, different risk levels, or a combination thereof. The TF refers to the angle measured in a plane perpendicular to the drillstring axis that is between a reference direction on the drillstring and a fixed reference.

The execution platform 320 may have both an edge portion and a cloud portion. The execution platform 320 may also include a rig control system 324. The execution platform 320 (e.g., the rig control system 324) may track the performance of the downhole tool 200 and may monitor and/or control the interaction with the planning platform 310, including whether to revise the drilling plan, the interaction with the user, the interaction with the rig control system 324, and the interaction with the downhole tool 200. The rig control system 324 may also receive channel data from the downhole platform 330 such as subsurface measurements (e.g., position, direction and inclination, pressure, temperature, resistivity, porosity, sonic velocity, gamma ray, etc.), the downhole drill state (DHDS), or a combination thereof. The rig control system 324 may also generate and transmit specific information to some of the downhole platform tools such as steering commands (e.g., TF, DLS, ROP, etc.), the operations mode (e.g., drilling, tripping, stopped for rig repair, etc.), or a combination thereof Downhole Platform 330

The downhole platform 330 may include or be a part of the downhole tool 200. In one embodiment, the downhole platform 330 may include a combination of the rotary steerable system (RSS) tools, measuring while drilling (MWD) tools, and logging while drilling (LWD) tools. For example, the downhole platform 330 may include a rotary steerable system (RSS) 322. The RSS 322 may be configured to generate and transmit to the rig control system 324 the working drilling plan 260, the mode selection (e.g., context, position, etc.), drill commands (e.g., TF, DLS, ROP, etc.), the downlink pattern, or a combination thereof.

The downhole platform 330 may include a downhole state estimator that is configured to automatically detect whether the drill bit 250 is on bottom or off bottom. The downhole platform 330 may be programmed with planned trajectory properties based at least partially upon the data from the planning platform 310. The downhole platform 330 may have knowledge of the state of the system (e.g., whether drilling is currently occurring). The downhole platform 330 may also be configured to estimate the ROP.

The downhole platform 330 may communicate with the planning platform 310 and/or the execution platform 320 during or after drilling to confirm that it is following the planned drilling trajectory 210 or to adjust steering parameters. More particularly, the downhole platform 330 may be configured to receive data from the rig control system 324 (i.e., downlink data). The data may include steering commands for the downhole tool 200, curvature context (e.g., the maximum DLS), saturation (e.g., DLS, risk, etc.), or a combination thereof.

The downhole platform 330 may also be configured to transmit data to the rig control system 324 (i.e., uplink data). The data may include survey points (e.g., actual toolface (TFa), desired toolface (TFd), actual steering ratio (SRa), continuous direction and inclination (cD&I)), the DHDS, the ROP, or a combination thereof. The SRa may be or include a percentage of the time that the downhole tool 200 is following a particular direction. For example, 100% means that the downhole tool 200 is following one particular direction the entire time, and 0% means a neutral condition where no particular toolface is being privileged. The DHDS may include whether the drill bit 250 is on bottom or not, the level of control of the steering capability, the selection (or not) to reset some parameters of the downhole tool (i.e., auto-reset), rotation detection, flow detection, or a combination thereof.

Figure 4:
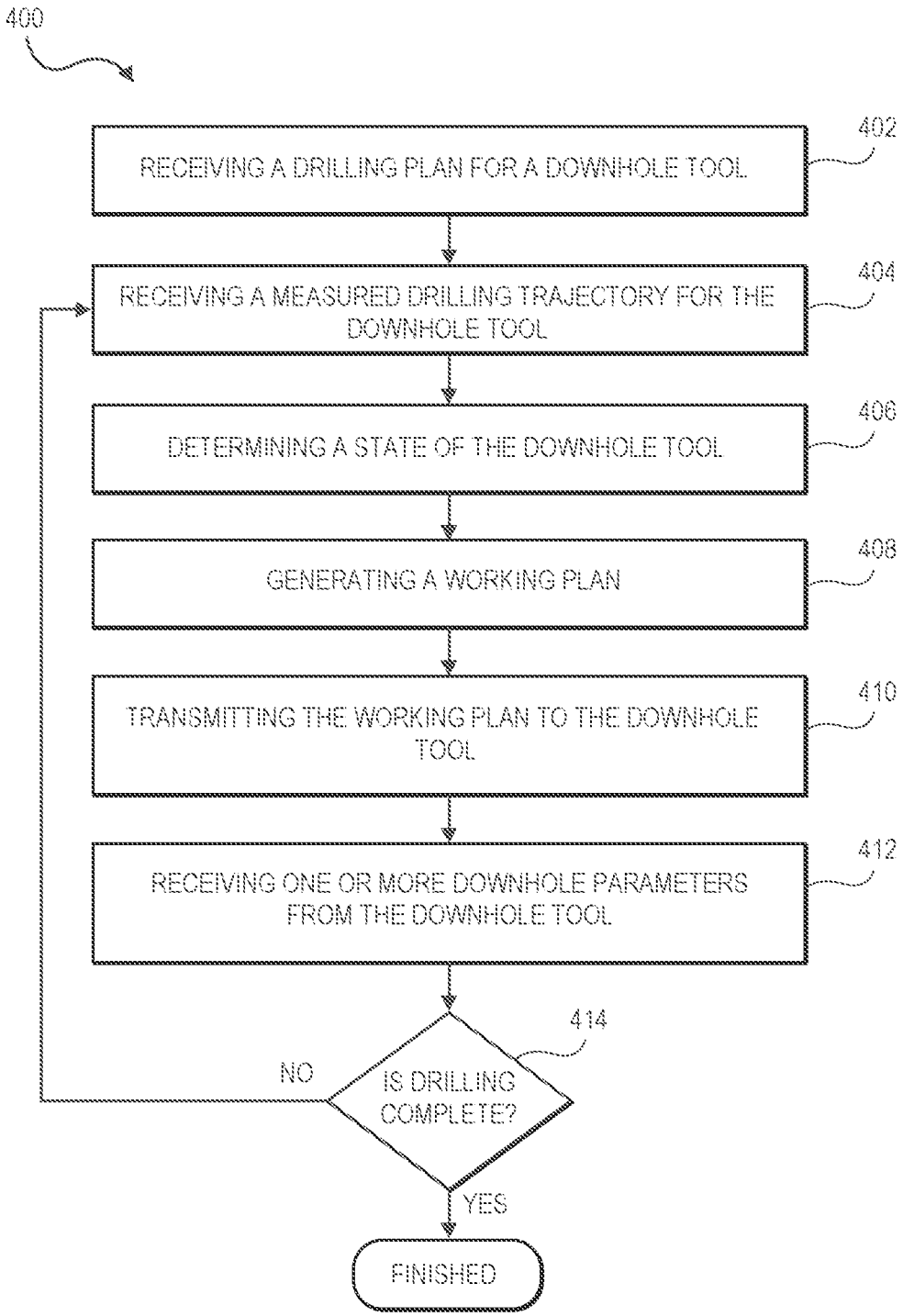
FIG. 4 illustrates a flowchart of a method for controlling a drilling trajectory of the downhole tool, according to an embodiment.

FIG. 4 illustrates a flowchart of a method 400 for monitoring and controlling a drilling trajectory of the downhole tool 200, according to an embodiment. An illustrative order of the method 400 is provided below; however, one or more portions of the method 400 may be performed in a different order, combined, split into sub-steps, repeated, or omitted. At least a portion of the method 400 may be performed by the computing system (described with respect to FIG. 5 below). For example, at least a portion of the method 400 may be performed by the execution platform 320 (e.g., the rig control system 324). In one embodiment, the method 400 may be performed without user intervention or input.

The method 400 may include receiving a drilling plan for the downhole tool 200, as at 402. The drilling plan may be received from the planning platform 310. As described above, in one example, the drilling plan may include the planned drilling trajectory 210, the target 220, the PS model(s), the DLS of the downhole tool 200, the possible zones in the subterranean formation, the anti-collision data, or a combination thereof.

The method 400 may also include receiving a measured drilling trajectory 230 for the downhole tool 200, as at 404. The measured drilling trajectory 230 may be measured by the MWD module 240 and/or the downhole platform 330, and then transmitted (i.e., uplinked) to the execution platform 320. The measured drilling trajectory 230 may be measured one or more times as the downhole tool 200 drills the first portion of the wellbore in the subterranean formation.

The method 400 may also include determining a state of the downhole tool 200, as at 406. The state of the downhole tool 200 may be determined (e.g., estimated) based at least partially upon the drilling plan from the planning platform 310, downhole parameters from the downhole platform 330, or both. As described below, the downhole parameters may include the measured drilling trajectory 230, the DHDS, the ROP, the mode, the TF, the steering ratio (SR), the measured DLS, or a combination thereof.

The state of the downhole tool 200 may include the location of the downhole tool 200 in the subterranean formation. The state of the downhole tool 200 may also include a difference (i.e., a comparison) between the location of the downhole tool 200 versus where the downhole tool 200 should be located (according to the drilling plan).

The state of the downhole tool 200 may also include the measured drilling trajectory 230 of the downhole tool 200 in the subterranean formation. The state of the downhole tool 200 may also include a difference between the planned drilling trajectory 210 and the measured drilling trajectory 230.

The state of the downhole tool 200 may also include the direction that the downhole tool 200 is drilling (e.g., steering) at one or more times/depths during drilling. The state of the downhole tool 200 may also include a level of control of the steering capability at one or more times/depths during drilling. For example, this may include a number of degrees that the steering direction deviates from the planned drilling trajectory 210 at one or more times/depths during drilling.

The state of the downhole tool 200 may also include the location of the end (e.g., bottom) of the wellbore. As seen in FIG. 2, the MWD module 240 may be located behind (e.g., above) the drill bit 250. Thus, the location of the end of the wellbore may be determined based upon the location of the MWD module 240, the distance between the MWD module 240 and the drill bit 250, the shape of the downhole tool 200 (e.g., the BHA), the direction that the downhole tool 200 is drilling (e.g., steering), or a combination thereof.

The state of the downhole tool 200 may also include whether the downhole tool 200 is on bottom or off bottom. The state of the downhole tool 200 may also include the ROP of the downhole tool 200 at one or more times/depths during drilling. The state of the downhole tool 200 may also include the steering efficiency factor (SEF), drilling parameters (DP), or a combination thereof. The SEF may be a measure in terms how well the toolface is maintained when trying to steer during a directional drilling operation. The state of the downhole tool 200 may also include a downlink detection (i.e., detection of a command being transmitted to/from the downhole tool 200).

The method 400 may also include generating a working plan, as at 408. The working plan may include the working drilling trajectory 260, a set of steering commands to achieve the working drilling trajectory 260, contextual information and constraints, violations, or a combination thereof. The working plan may be based at least partially upon the drilling plan (e.g., from the planning platform 310), the state of the downhole tool 200, or both. In one example, the working plan may be generated based at least partially upon anti-collision data from the drilling plan. The working plan may also or instead be generated based at least partially upon constraints, violations, contexts as determined by the execution platform 320. As used herein, anti-collision data refers to the location of nearby wells that are to be avoided while executing the directional well construction. As used herein, constraints refer to the maximum allowable deviation from the original drilling plan (e.g., the planned drilling trajectory 210), maximum dogleg severity, maximum tortuosity leaseline limits as defined by the client, maximum carbon emission, or a combination thereof. As used herein, violations refer to the portion of the working plan that exceed one of more of the constraints previously defined. Violations may include spatial violations, angular violation (e.g., inclination and azimuth violation), dogleg violation, tortuosity violation, or a combination thereof. As used herein, contexts refer to the type of curvature that is currently being executed (e.g., vertical, curve, horizontal, landing, nudge, etc.) and also specific formation behaviors.

In one embodiment, a plurality of different working drilling trajectories may be generated. Each of the working drilling trajectories may be different because they may be generated using different parameters. For example, they may have different trajectory lengths, different steering capacities, different spatial or angular deviations from the original plan, different tortuosities, different endpoint targets, different numbers of curvatures, different steering risks, different dogleg capabilities, different confidence levels to deliver the trajectory, different hole quality indices, different geomechanics requirements, different violations, different projected carbon emission, or a combination thereof. The working drilling trajectories may be ranked based upon one or more parameters listed above. One or more of the working drilling trajectories (e.g., with the highest ranking) may then be selected. In one embodiment, the one or more selected working drilling trajectories 260 may be displayed to a user for validation (e.g., depending on the level of automation of the system).

The method 400 may also include transmitting the working plan to the downhole tool 200, as at 410. More particularly, this may include using a downlink advisor in the execution platform 320 to transmit one or more downlink commands to the downhole platform 330 in the downhole tool 200 to implement and achieve the working plan. The downhole tool 200 may maintain or modify its trajectory in response to the working plan. In other words, the downhole tool 200 may switch from the planned drilling trajectory 210 to the working drilling trajectory 260 to steer toward the target 220 to drill the second portion of the wellbore.

The method 400 may also include receiving one or more downhole parameters from the downhole tool 200, as at 412. The downhole parameters may be measured by the MWD module 240 and/or the downhole platform 330 of the downhole tool 200 simultaneously with and/or after the working plan has been implemented by the downhole tool 200. The downhole parameters may be or include the DHDS, the ROP, the direction and inclination (cD&I), the shock and vibration, the stick and slip, the steering response, the steering efficiency factor (SEF), the actual steering commands (TFa, SRa), the desired steering commands (TFd, SRd), the downhole flow rate, the downhole RPM, the downhole power output of one or more downhole tools, the downhole subsurface measurement (e.g., pressure, temperature, resistivity, porosity, sonic velocity, gamma ray, etc.), the downhole event record, the downhole tool configuration, the downhole tool calibrations, the downhole continuous survey record, the downhole tool issues, or a combination thereof.

The method 400 may then loop back to step 404 and repeat steps 404-412. This loop may occur one or more times to continue re-determine the state of the downhole tool 200 and/or to modify (e.g., re-generate) the working plan to steer the downhole tool 200 as the wellbore is drilled.

Figure 5:
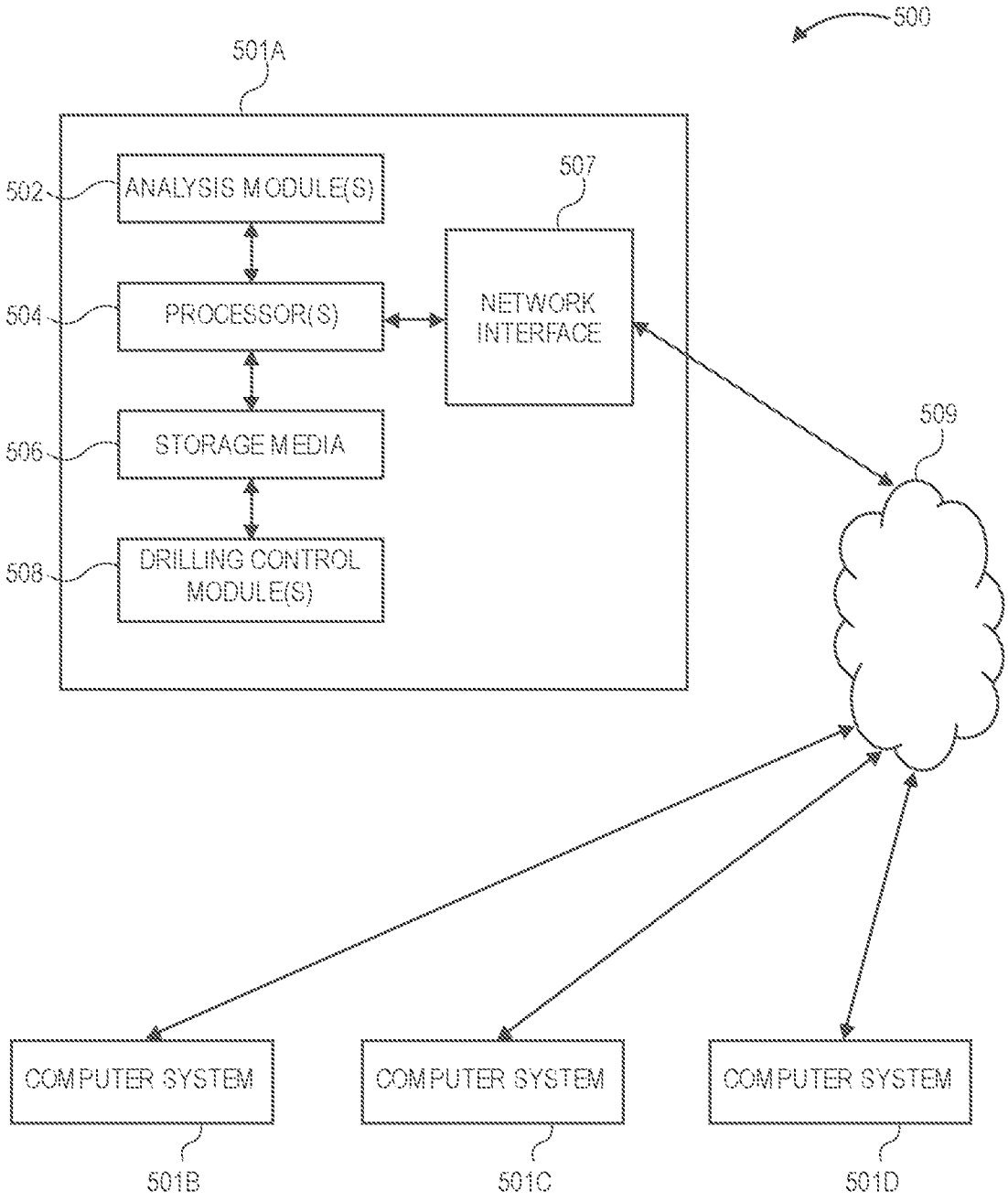
FIG. 5 illustrates a schematic view of a computing system for performing at least a portion of the method, according to an embodiment.

In some embodiments, the methods of the present disclosure may be executed by a computing system. FIG. 5 illustrates an example of such a computing system 500, in accordance with some embodiments. The computing system 500 may include a computer or computer system 501A, which may be an individual computer system 501A or an arrangement of distributed computer systems. The computer system 501A includes one or more analysis modules 502 that are configured to perform various tasks according to some embodiments, such as one or more methods disclosed herein. To perform these various tasks, the analysis module 602 executes independently, or in coordination with, one or more processors 504, which is (or are) connected to one or more storage media 506. The processor(s) 504 is (or are) also connected to a network interface 507 to allow the computer system 501A to communicate over a data network 509 with one or more additional computer systems and/or computing systems, such as 501B, 501C, and/or 501D (note that computer systems 501B, 501C and/or 501D may or may not share the same architecture as computer system 501A, and may be located in different physical locations, e.g., computer systems 501A and 501B may be located in a processing facility, while in communication with one or more computer systems such as 501C and/or 501D that are located in one or more data centers, and/or located in varying countries on different continents).

A processor may include a microprocessor, microcontroller, processor module or subsystem, programmable integrated circuit, programmable gate array, or another control or computing device.

The storage media 506 may be implemented as one or more computer-readable or machine-readable storage media. Note that while in the example embodiment of FIG. 5 storage media 506 is depicted as within computer system 501A, in some embodiments, storage media 506 may be distributed within and/or across multiple internal and/or external enclosures of computing system 501A and/or additional computing systems. Storage media 506 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 500 contains one or more drilling control module(s) 508. In the example of computing system 500, computer system 501A includes the drilling control module 508. In some embodiments, a single drilling control module 508 may be used to perform some aspects of one or more embodiments of the methods disclosed herein. In other embodiments, a plurality of drilling control modules 508 may be used to perform some aspects of methods herein.

It should be appreciated that computing system 500 is merely one example of a computing system, and that computing system 500 may have more or fewer components than shown, may combine additional components not depicted in the example embodiment of FIG. 5, and/or computing system 500 may have a different configuration or arrangement of the components depicted in FIG. 5. The various components shown in FIG. 5 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 500, FIG. 5), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. A method for controlling a drilling trajectory of a downhole tool, the method comprising:

receiving a drilling plan for a downhole tool to drill a wellbore from a surface of a subterranean formation toward a target in the subterranean formation, wherein the drilling plan comprises a planned drilling trajectory for the downhole tool, a model of a steering capability for the downhole tool, an estimated dogleg severity for the downhole tool, and properties of the subterranean formation, and wherein the planned drilling trajectory is a first path extending from the surface to the target;

receiving a measured drilling trajectory of the downhole tool after the downhole tool drills a first portion of the wellbore using the planned drilling trajectory, wherein the measured drilling trajectory is an actual trajectory of the downhole tool along a second path through the first portion of the wellbore determined via one or more sensors disposed on the downhole tool, wherein the second path deviates from the first path;

determining a state of the downhole tool based at least partially upon the planned drilling trajectory, the model, the estimated dogleg severity, the properties of the subterranean formation, and the measured drilling trajectory, wherein the state comprises a difference between the first path associated with the planned drilling trajectory and the second path associated with the actual trajectory of the downhole tool, a level of control of the steering capability of the downhole tool, and a location of an end of the wellbore;

generating a working plan trajectory based at least partially upon the drilling plan and the state of the downhole tool, wherein the working plan trajectory is a third path extending from a current location along the second path to the target, wherein the downhole tool is configured to switch from the planned drilling trajectory to the working plan trajectory to drill a second portion of the wellbore along the third path toward the target in the subterranean formation;

transmitting the working plan trajectory to the downhole tool to cause the downhole tool to drill the second portion of the wellbore along the third path toward the target in the subterranean formation;

measuring one or more downhole parameters after the downhole tool has switched to the working plan trajectory, wherein the one or more downhole parameters include a measured dogleg severity that is measured by the downhole tool and a downhole drill state of the downhole tool, wherein the downhole drill state is determined based at least partially upon the estimated dogleg severity and the measured dogleg severity; and transmitting the one or more downhole parameters to an execution platform configured to control operation of the downhole tool.

2. The method of claim 1, wherein the state is also determined based at least partially upon a toolface of the downhole tool and a steering ratio of the downhole tool, and wherein the state also comprises a steering efficiency factor and one or more drilling parameters.

3. The method of claim 2, wherein the downhole tool automatically resets one or more of the one or more drilling parameters to achieve the working plan trajectory.

4. The method of claim 1, wherein the location of the end of the wellbore is based at least partially upon at least one of a location of a sensor of the one or more sensors on the downhole tool, a distance between the sensor and a drill bit of the downhole tool, a shape of the downhole tool, or a direction that the downhole tool is drilling.

5. The method of claim 1, wherein the drilling plan also comprises anti-collision data, and wherein the working plan trajectory is generated based at least partially upon the anti-collision data.

6. The method of claim 1, wherein generating the working plan trajectory comprises:

generating a plurality of working plan trajectories, wherein each of the plurality of working plan trajectories is a respective path from the current location along the second path to the target in the subterranean formation;

ranking the plurality of working plan trajectories; and selecting one of the plurality of working plan trajectories based upon the ranking.

7. The method of claim 1, wherein the one or more downhole parameters further include a rate of penetration of the downhole tool.

8. The method of claim 1, further comprising:

determining a new state of the downhole tool based at least partially upon the planned drilling trajectory, the measured drilling trajectory, and the one or more downhole parameters; and generating a new working plan trajectory based at least partially upon the new state of the downhole tool.

9. The method of claim 1, wherein the model of the steering capability for the downhole tool comprises a neutral steering tendency of the downhole tool, wherein the neutral steering tendency is indicative of a default steering tendency of the downhole tool when no command direction is provided to the downhole tool.

10. A computing system, comprising:

one or more processors; and a memory system comprising one or more non-transitory computer-readable media storing instructions that, when executed by at least one of the one or more processors, cause the computing system to perform operations, the operations comprising:

receiving a drilling plan for a downhole tool to drill a wellbore from a surface of a subterranean formation toward a target in the subterranean formation, wherein the drilling plan comprises a planned drilling trajectory for the downhole tool, a predictive steering model for the downhole tool, an estimated dogleg severity for the downhole tool, and properties of the subterranean formation, and wherein the planned drilling trajectory is a first path extending from the surface to the target;

receiving a measured drilling trajectory of the downhole tool after the downhole tool drills a first portion of the wellbore using the planned drilling trajectory, wherein the measured drilling trajectory is an actual trajectory of the downhole tool along a second path through the first portion of the wellbore determined via one or more sensors disposed on the downhole tool, and wherein the second path deviates from the first path;

determining a state of the downhole tool based at least partially upon the planned drilling trajectory, the predictive steering model, the estimated dogleg severity, the properties of the subterranean formation, and the measured drilling trajectory, wherein the state comprises a difference between the first path associated with the planned drilling trajectory and the second path associated with the actual trajectory, a level of control of a steering capability of the downhole tool, and a location of an end of the wellbore;

generating a working plan trajectory based at least partially upon the state of the downhole tool, wherein the working plan trajectory is a third path extending from a current location along the second path to the target, wherein the downhole tool is configured to switch from the planned drilling trajectory to the working plan trajectory to drill a second portion of the wellbore along the third path toward the target in the subterranean formation;

transmitting the working plan trajectory to the downhole tool to cause the downhole tool to drill the second portion of the wellbore along the third path toward the target in the subterranean formation;

measuring one or more downhole parameters after the downhole tool has switched to the working plan trajectory, wherein the one or more downhole parameters include a measured dogleg severity that is measured by the downhole tool and a downhole drill state of the downhole tool, wherein the downhole drill state is determined based at least partially upon the estimated dogleg severity and the measured dogleg severity; and transmitting the one or more downhole parameters to an execution platform configured to control operation of the downhole tool.

11. The computing system of claim 10, wherein the drilling plan also comprises anti-collision data, and wherein the working plan trajectory is generated based at least partially upon the anti-collision data.

12. The computing system of claim 10, wherein the one or more downhole parameters further include a rate of penetration of the downhole tool.

13. The computing system of claim 12, wherein the operations further comprise:

determining a new state of the downhole tool based at least partially upon the planned drilling trajectory, the predictive steering model, the estimated dogleg severity, the properties of the subterranean formation, the measured drilling trajectory, and the one or more downhole parameters; and generating a new working plan trajectory based at least partially upon the new state of the downhole tool.

14. The computing system of claim 10, wherein generating the working plan trajectory comprises:

generating a plurality of working plan trajectories, wherein each of the plurality of working plan trajectories is a respective path extending from the current location of the downhole tool along the second path to the target in the subterranean formation;

ranking the plurality of working plan trajectories;

selecting one of the plurality of working plan trajectories based upon the ranking; and transmitting the selected working plan trajectory to the downhole tool to cause the downhole tool to steer along the respective path toward the target.

15. The computing system of claim 10, wherein the state is determined based at least partially upon a steering ratio of the downhole tool, the state comprises a steering efficiency factor and a plurality of drilling parameters, and the downhole tool is configured to automatically reset one or more of the plurality of drilling parameters to achieve the working plan trajectory.

16. The computing system of claim 10, wherein the location of the end of the wellbore is based at least partially upon at least one of a location of a sensor of the one or more sensors on the downhole tool, a distance between the sensor and a drill bit of the downhole tool, a shape of the downhole tool, or a direction that the downhole tool is drilling.

17. A system for controlling a drilling trajectory of a downhole tool, the system comprising:

one or more processors coupled to one or more storage media, one or more sensors, and a communication interface configured to communicate via a network;

a planning platform located at a surface, wherein the planning platform is configured to, via the one or more processors, generate a drilling plan for a downhole tool to drill a wellbore from the surface toward a target in a subterranean formation, wherein the drilling plan comprises a planned drilling trajectory for the downhole tool, a predictive steering model for the downhole tool, an estimated dogleg severity for the downhole tool, properties of the subterranean formation, and anti-collision data, and wherein the planned drilling trajectory is a first path extending from the surface to the target;

an execution platform also located at the surface and in communication with the planning platform, wherein the execution platform is configured to:

receive, via the network, a measured drilling trajectory of the downhole tool after the downhole tool drills a first portion of the wellbore using the planned drilling trajectory, wherein the measured drilling trajectory is an actual trajectory of the downhole tool along a second path through the first portion of the wellbore determined via one or more sensors disposed on the downhole tool, wherein the second path deviates from the first path;

determine, via the one or more processors, a state of the downhole tool based at least partially upon the planned drilling trajectory, the predictive steering model, the estimated dogleg severity, the properties of the subterranean formation, and the measured drilling trajectory, wherein the state comprises a difference between the first path associated with the planned drilling trajectory and the second path associated with the actual trajectory, a level of control of a steering capability of the downhole tool, and a location of an end of the wellbore; and generate, via the one or more processors, a working plan trajectory based at least partially upon the state of the downhole tool and the anti-collision data, wherein generating the working plan trajectory comprises:

generating a plurality of working plan trajectories, wherein each of the plurality of working plan trajectories is a respective path extending from a current location of the downhole tool along the second path to the target in the subterranean formation;

ranking the plurality of working plan trajectories; and selecting one of the plurality of working plan trajectories based upon the ranking; and a drilling platform located in the downhole tool, wherein the drilling platform is in communication with the execution platform via the communication interface and the network, and wherein the drilling platform is configured to:

receive, via the network, the working plan trajectory from the execution platform to cause the downhole tool to drill a second portion of the wellbore along the respective path associated with the working plan trajectory toward the target in the subterranean formation;

measure, via the one or more sensors, one or more downhole parameters after the downhole tool has switched to the working plan trajectory, wherein the one or more downhole parameters include a measured dogleg severity that is measured by the downhole tool, a downhole drill state of the downhole tool, and a rate of penetration of the downhole tool, wherein the downhole drill state is determined based at least partially upon the estimated dogleg severity and the measured dogleg severity; and transmit, via the network, the one or more downhole parameters to the execution platform.

18. The system of claim 17, wherein the execution platform is further configured to determine, via the one or more processors, a new state of the downhole tool based at least partially upon the planned drilling trajectory, the predictive steering model, the estimated dogleg severity, the properties of the subterranean formation, the measured drilling trajectory, and the one or more downhole parameters.

19. The system of claim 17, wherein the execution platform is further configured to generate, via the one or more processors, a new working plan trajectory based at least partially upon the downhole drill state of the downhole tool.

20. The system of claim 17, wherein the state further comprises one or more drilling parameters, and wherein the execution platform is configured to adjust the one or more drilling parameters to achieve the working plan trajectory.

* * * * *